United States Patent [19]

Lacewell

[11] 4,199,077

[45] Apr. 22, 1980

[54] VENDING MACHINE FOR NEWSPAPERS AND MAGAZINES

[76] Inventor: Truman M. Lacewell, Rte. 1, Mt. Vernon, Ark. 72111

[21] Appl. No.: 927,875

[22] Filed: Jul. 25, 1978

[51] Int. Cl.[2] ..... B65H 3/22

[52] U.S. Cl. ..... 221/213

[58] Field of Search ..... 221/213, 211, 212, 214, 221/215, 216, 220, 227, 277, 231; 194/2; 271/42, 18.3, 128

[56] References Cited

U.S. PATENT DOCUMENTS

| | | | |
|---|---|---|---|
| 1,285,187 | 11/1918 | Hotaling | 221/213 |
| 2,428,231 | 9/1947 | Leschin | 221/213 UX |
| 3,208,635 | 9/1965 | Saxe et al. | 221/213 X |

*Primary Examiner*—Stanley H. Tollberg

*Attorney, Agent, or Firm*—Clarence A. O'Brien; Harvey B. Jacobson

[57] ABSTRACT

A vending machine is disclosed for newspapers and magazines with a gripping means held on an arm pivotable about a vertical shaft, where the arm is free to move downwardly as depletion of the stack of newspapers or magazines proceeds. An enclosing housing, along with a shield plate, assures dispensing of articles only when inserted coins permit turning of the shaft by a handle above and outside the housing.

4 Claims, 7 Drawing Figures

VENDING MACHINE FOR NEWSPAPERS AND MAGAZINES

BACKGROUND OF THE INVENTION

1. Field of the Invention

The invention relates to a dispensing or vending device, particularly for individual vending of flat paper articles horizontally arranged to form a stack.

2. Description of the Prior Art

Vending machines of varying construction have been described for dispensing, vending, or issuing flat paper articles, such as newspapers or magazines.

Exemplary of prior art vending machines where a pin engages and removes the top article from a stack, and the pin slides the top article to an exit slot when moved in the direction of the slot are U.S. Pat. No. 3,463,356, issued Aug. 26, 1969, to Gatti; U.S. Pat. No. 3,934,754, issued Jan. 27, 1976, to Dutro; U.S. Pat. No. 3,063,597, issued Nov. 13, 1962, to Burdis et al; and U.S. Pat. No. 2,854,168, issued Sept. 30, 1958, to Abrams et al. Each of these four patents shows use of one or a plurality of such pins, with the pins being moved linearly by a mechanism following a fixed track.

Newspaper or magazine vending devices which employ other gripping means, but still disclosing a linear path of travel of the gripping means, are shown in U.S. Pat. No. 3,917,114, issued Nov. 4, 1975, to Grosse; U.S. Pat. No. 2,819,817, issued Jan. 14, 1958, to MacKenzie et al; and U.S. Pat. No. 3,042,250, issued July 3, 1962, to Watlington.

Many of the prior art vending devices suffer from drawbacks resulting from relative complexity of construction and operation, with the result that mechanical failure is common under severe conditions of usage, such as is typically encountered in outdoor locations, where such vending devices are usually located. Another drawback of dispensing devices characterized by complexity of construction is an increased tendency to jam or retain deposited coins without furnishing the desired article. To the extent that such malfunctioning is a significant cause of vandalism directed to newspaper or magazine vending machines, such complexity represents a significant economic loss by owners of such machines for machine maintenance and replacement costs.

Devices for retail selling of a single copy of a newspaper or a magazine typically are constructed to permit access to an entire stack of newspapers or magazines upon insertion of the proper combination of coins. While receipts to the wholesaler should be proportional to the number of items placed in such a device, surveys have shown a shortage of receipts which can be accounted for only by making the assumption that an individual purchaser takes more than one copy of the article. Articles of greater intrinsic value can be expected to present a greater risk of theft, and loss of even less expensive articles is known to represent a significant economic loss to the distributor.

Yet a further drawback of existing vending devices is represented by the need to provide a fixed track for guiding a gripping mechanism which functions at the top of a stack of articles. Such a mechanism must necessarily be independent of the mechanism employed to permit activation of the device when the proper combination of coins have been deposited, thereby introducing an additional element of complexity.

SUMMARY OF THE INVENTION

It is an object of the present invention to provide a relatively simple vending mechanism for dispensing individually a newspaper or magazine from a stack horizontally arranged inside a housing.

Another object of the invention is to prevent access to the entire stack during the dispensing operation.

Still another object is to provide a rotatable shaft connected to a push plate with gripping means, the shaft being easily associated with the unlocking mechanism which permits operation of the device when the proper combination of coins has been deposited by a consumer of the article dispensed.

Yet another object of the invention is to reduce the incidence of vandalism and maintenance to a newspaper or magazine vending machine by providing a construction with a minimum of moving parts and simplicity of operation.

Yet a further object of the invention is to provide a vending machine constructed economically from commonly available materials, with a minimum of assembly steps required, and which is efficient in operation and easy to both reload with a new stack of articles, and easy to operate by the retail consumer.

Further objects are attained by use of a horizontal push plate resting upon the top of the stack of articles, the push plate being pivotable in a horizontal plane about a shaft on which a collar attached to the push plate can be rotated. Gripping means on the push plate are effective to push articles in the direction of ejection, but slide freely in the reverse direction as the push plate retracts to its resting position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
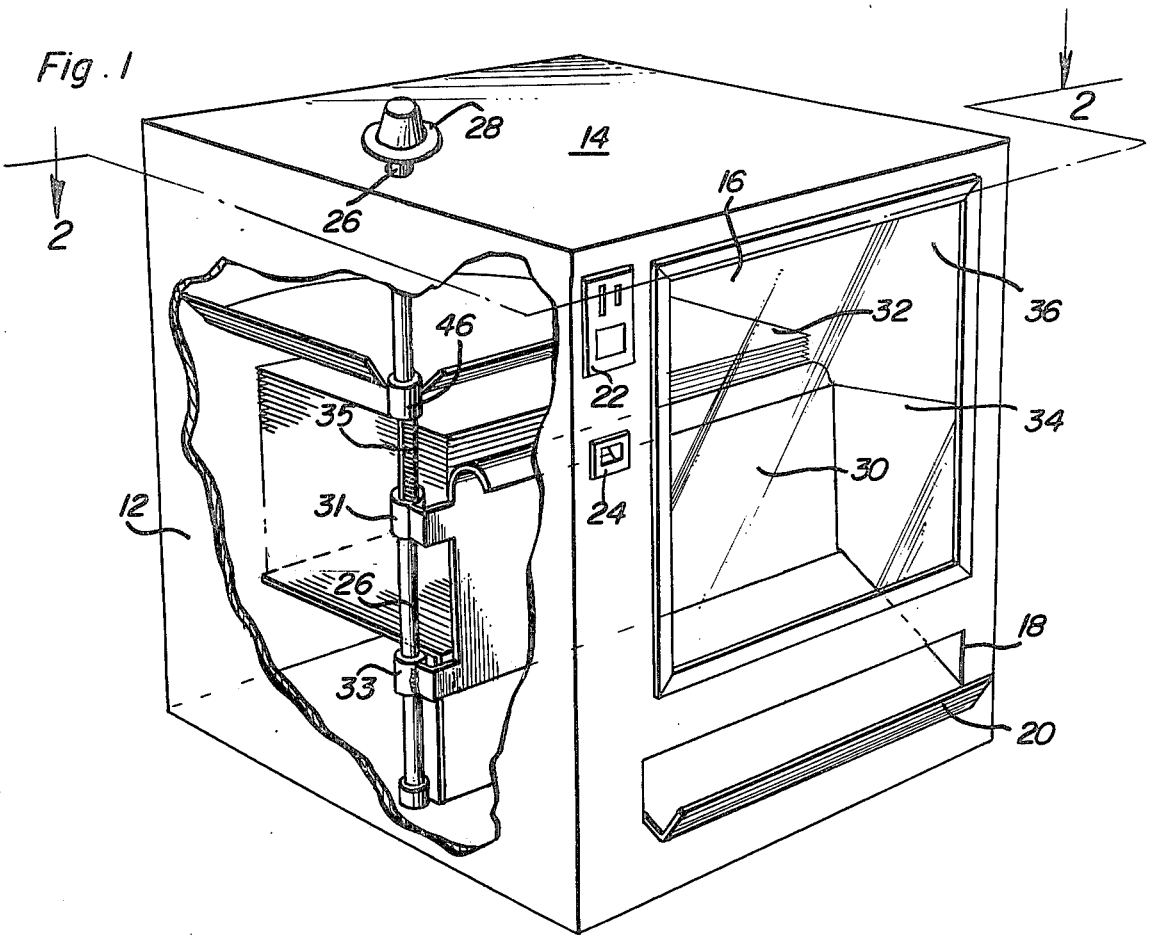
FIG. 1 is a perspective view of the exterior of the vending machine for newspapers or magazines in condition for operation.
Figure 2:
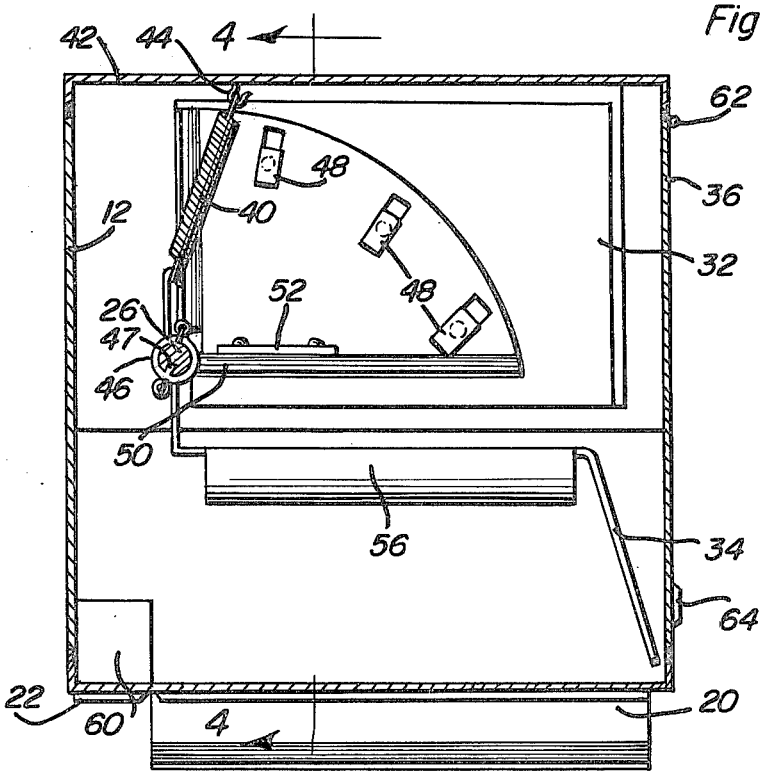
FIG. 2 is a top sectional view of the machine taken substantially upon a plane passing along section line 2—2 on FIG. 1, showing the parts in resting, non-actuated condition.

The vending machine of the present invention is designated generally by the numeral 10 in FIG. 1 and comprises a housing with side panel 12, top panel 14, front window 16, ejector slot 18, ejector trough 20, coin feed 22, coin return 24, shaft 26, and dispenser knob 28. Shield 30 is visible through window 16 and prevents theft of articles from stack 32. Shield 30 is supported on shaft 26 by collars 31 and 33, upper collar 31 being attached to keyed collar 46 by springs 35 and 37. Also visible in FIG. 1 is wing 34 of shield 30, and side door 36 for providing access to the interior of the device. FIG. 2 shows the device in its resting, non-actuated state, with push plate 38 in fully retracted position, held under tension from spring 40, attached to back plate 42 by hook 44. Push plate 38 is attached to shaft 26 by keyed collar 46, which is free to slide upwardly and downwardly on shaft 26 as the height of the stack of papers changes or when a new stack is inserted during reloading of the device. Shield 30 follows collar 46 upwardly and downwardly through springs 35 and 37. Collar 46 has inward projection 47, which mates with a longitudinal groove in shaft 26. Three pin assemblies 48 grip the articles from stack 32 as shaft 26 is rotated from above and collar 46 in engagement with shaft 26 rotates push plate 38 connected to collar 46 through mounting bracket 50. Spring mounting base 52 is bolted to bracket 50 and holds hook 54, through which spring 40 is engaged. Shield plate 30 has an upper lip 56 over which articles from stack 32 are guided as push plate 38 rotates into the configuration of FIG 3. Upper top 56 has a radius edge which provides interference to help separate articles during dispensing.

Figure 3:
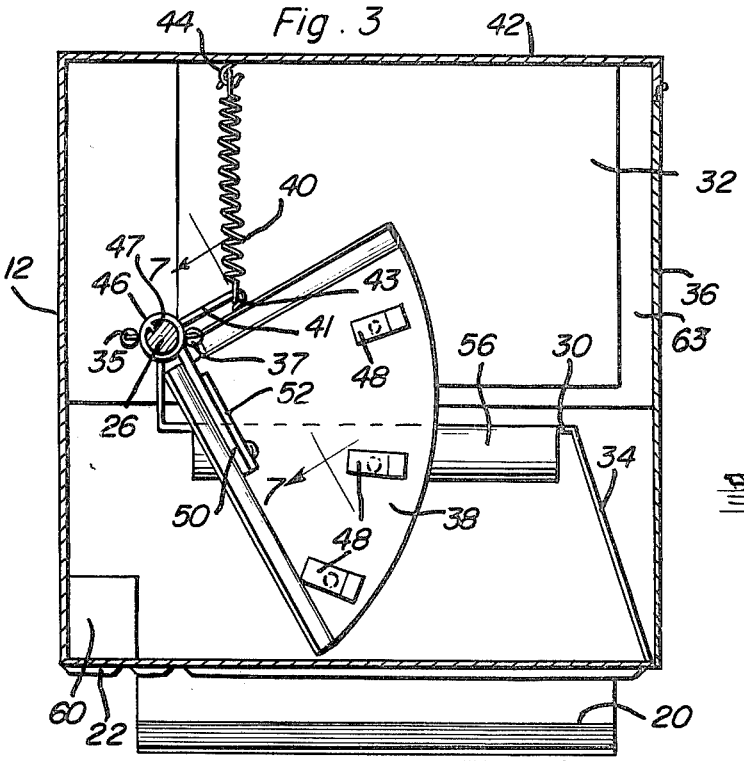
FIG. 3 is a top sectional view taken as in FIG. 2, but showing the parts after actuation to dispense an article from a stack in the machine.

In FIG. 3, the push plate 38 can be seen rotated as the result of clockwise manual turning of knob 28 fastened above top panel 14 at the upper end of shaft 26. Spring 40 is shown somewhat extended under the tension resulting from its extension after clockwise rotation of push plate 38. The configuration shown in FIG. 3 is that which results after an article has been dispensed and rests in trough 20. Also shown on FIGS. 2 and 3 is coin box 60, which is conventional in operation, and permits turning of knob 28 and shaft 26 when the proper coins have been deposited, by use of a mechanism not shown in FIGS. 2 or 3. Also shown in FIGS. 2 and 3 are hinges 62 and lock 64 on door 36, both of conventional construction.

Figure 4:
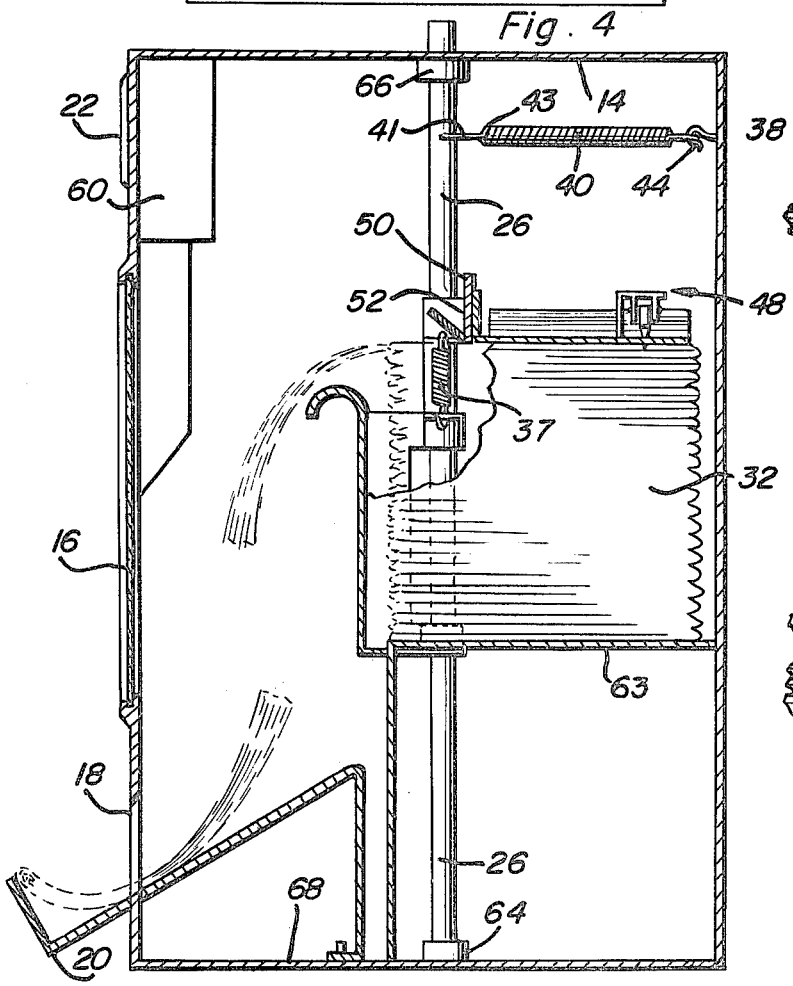
FIG. 4 is a side sectional view taken substantially upon a plane passing along section line 4—4 on FIG. 2, showing the parts in their resting, non-actuated condition, but showing in phantom the passage of articles as dispensed from the device.

In FIG. 4, stack 32 of articles is shown resting on support plate 62, shaft 26 being shown mounted in bearings 64 and 66, respectively anchored to base plate 68 and top plate 14 of the housing. Two articles 70 and 72 are shown in phantom to illustrate their downward path of travel as the articles are dispensed from stack 32. Spring 40 connects to shaft 26 by means of rod 41 with eyelet 43. Also shown in FIG. 4 is one possible mechanism for changing the relative orientation of the top of stack 32 with lip 56 of shield plate 30. This can be accomplished in several ways, such as by providing tension means, such as a spring, between base 62 and stack 32 so as to maintain a nearly uniform height of the top of stack 32. However, as is shown in FIGS. 1–4, shield plate 30 can be made vertically movable, such as by mounting on shaft 26 responsive to the level of collar 46 mounted on shaft 26.

Figure 5:
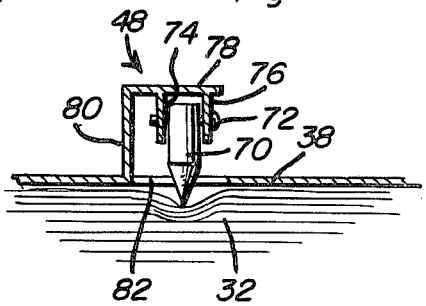
FIG. 5 is an enlarged, fragmentary, sectional view of the gripping means used to push the top article from the stack stored within the machine, taken in a direction tangent to the circular path of motion of the pin.
Figure 6:
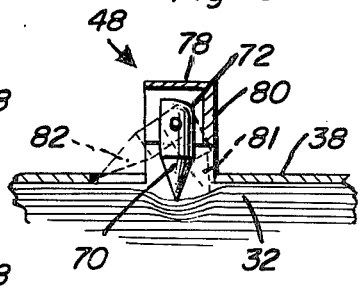
FIG. 6 is an enlarged, fragmentary, sectional view of the gripping means, taken in the radial direction.

Details of construction and operation of pin assembly 48 can be seen from FIGS. 5 and 6, FIG. 5 showing the assembly comprising gripping pin 70, which is pivotally mounted on pivot pin 72 passing through mounting wings 74 and 76. Wings 74 and 76 are welded or otherwise attached to the upper surface 78 of angle bracket 80, which is mounted at its base to push plate 38. Through aperture 82 in push plate 38, gripping pin 70 penetrates into stack 32 and grippingly engages the topmost article of stack 32.

Referring specifically to FIG. 6, as pin assembly 48 is moved in a leftward direction, gripping pin 70, which can be made of a firm elastic material, such as rubber or soft plastic, is pushed against retainer plate 80 to the engagement position 81 shown in phantom and causes the topmost article in stack 32 to move leftwardly, along with push plate 38. However, with movement of push plate 38 in a rightward direction, gripping pin 70 pivots about pivot pin 72 and rotates clockwise to the retraction position 82 shown in phantom, thereby slipping over the topmost article in stack 32. Consequently, as articles are dispensed pivot pin assembly 48 slides repeatedly over the stack to grip and convey articles horizontally only in the desired direction, responsive to repeated clockwise and counterclockwise rotation of shaft 26 between the limits shown on FIGS. 2 and 3.

Figure 7:
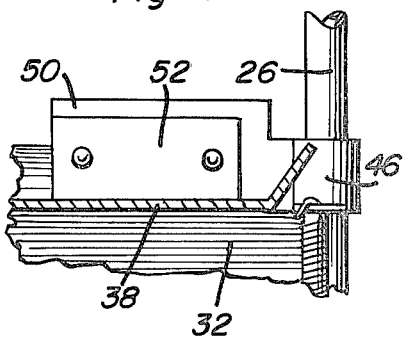
FIG. 7 is an enlarged, fragmentary, sectional view of the push plate assembly, showing details of the mounting structure on the vertical actuating shaft.

FIG. 7 shows push plate 38 and the associated mounting structure for mounting push plate 38 on vertically slotted shaft 26 through keyed collar 46.

In operation, when the proper combination of coins is deposited through coin feed 22, a coin control mechanism (not shown) releases shaft 26 for one forward clockwise rotation through the angle necessary to dispense one copy of an article from stack 32, finally reaching the configuration shown in FIG. 3. This action rotatively moves pin assemblies 48 toward the front of the device, pins 70 gripping the article from stack 32 in the manner described above and conveying the article forward over lip 56 of shield plate 30. Upon release of handle 28 and retrieval of the article from trough 20, push plate 38 returns to the position shown in FIG. 2 through action of spring 40, returning shaft 26 by counterclockwise rotation to its resting or non-actuated position shown in FIG. 2. The coin control mechanism (not shown) permits clockwise rotation of shaft 26 only upon redeposition of the proper combination of coins through coin feed 22. Optionally, the coin control mechanism can operate by permitting free rotation of shaft 26 by turning of knob 28 through a slip clutch or other mechanism until the proper combination of coins is deposited. Such an arrangement would be less susceptible to vandalism than a locking arrangement which holds shaft 26 non-rotatable until the proper coins are deposited. Also optionally provided is a ratchet mechanism for preventing counterclockwise or return movement of shaft 26 until the full clockwise or forward stroke has been completed. Such a device, if used, would prevent unauthorized dispensing of more than one article by action of a succession of short rotations of shaft 26 near the midpoint of a full stroke.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for dispensing individual flat paper articles horizontally arranged to form a stack within the device, comprising, in combination, a housing having a discharge aperture therein, a longitudinally grooved vertical shaft rotatably mounted in bearing surfaces within the housing, the shaft projecting upwardly through the housing, support means freely slidable vertically on said shaft and rotatable horizontally with rotation of said shaft, and gripping means mounted on said support means for moving the topmost of said articles from said stack for dispensing through said discharge aperture, wherein said support means comprises a horizontal push plate above said topmost of said articles, the push plate being attached to engaging means freely slidable vertically on said shaft and rotatable horizontally with said shaft, wherein said gripping means comprises a plurality of pin assemblies mounted on said horizontal plate, wherein each of said pin assemblies comprises a vertically depending gripping pin rotatably pivotable about a pivot pin held by mounting means attached to said push plate, said pivot pin being aligned in a horizontal radial direction with respect to said shaft, said mounting means having a retainer plate to limit the backward rotation of said gripping pin about said pivot pin during rotation of said shaft in dispensing the topmost of said articles.

2. The device of claim 1, together with a horizontal shield plate to prevent access through said discharge aperture to said stack, said plate having an outwardly and downwardly curling lip to facilitate separation of the topmost of said articles from said stack.

3. The device of claim 2, together with a downwardly sloping discharge trough for guiding individual paper articles through said discharge aperture and retaining said articles for removal.

4. The device of claim 3, together with spring bias means connecting said plate to said frame for return of said plate following dispensing of said paper articles.

* * * * *